US008297484B2

(12) United States Patent
Jesewitz et al.

(10) Patent No.: US 8,297,484 B2
(45) Date of Patent: Oct. 30, 2012

(54) HEIGHT ADJUSTABLE TOWER AND CARGO RACK APPARATUS FOR WAKEBOARD BOATS

(76) Inventors: Raymond L. Jesewitz, Longwood, FL (US); Derek Drew Geary, Cocoa, FL (US)

( * ) Notice: Subject to any disclaimer, the term of this patent is extended or adjusted under 35 U.S.C. 154(b) by 0 days.

(21) Appl. No.: 13/180,542

(22) Filed: Jul. 11, 2011

(65) Prior Publication Data

US 2011/0278335 A1 Nov. 17, 2011

Related U.S. Application Data

(63) Continuation-in-part of application No. 11/711,282, filed on Feb. 27, 2006, now Pat. No. 8,025,194.

(60) Provisional application No. 60/777,060, filed on Feb. 27, 2006, provisional application No. 61/363,259, filed on Jul. 11, 2010, provisional application No. 61/323,005, filed on Apr. 12, 2010.

(51) Int. Cl.
*B60R 9/00* (2006.01)
*B63B 17/00* (2006.01)

(52) U.S. Cl. ..... 224/406; 114/343

(58) Field of Classification Search ..... 224/406, 224/274, 405, 311, 280, 401, 282, 548, 549, 224/553; 114/343, 364, 346, 361
See application file for complete search history.

(56) References Cited

U.S. PATENT DOCUMENTS

| | | | | |
|---|---|---|---|---|
| 6,439,150 | B1 * | 8/2002 | Murphy et al. | 114/361 |
| 6,799,529 | B1 * | 10/2004 | Willis | 114/361 |
| 7,490,574 | B2 * | 2/2009 | Shearer et al. | 114/361 |
| D606,481 | S * | 12/2009 | Stepp | D12/317 |
| 7,950,342 | B2 * | 5/2011 | Russikoff | 114/361 |
| 8,025,194 | B2 * | 9/2011 | Jesewitz | 224/406 |
| 8,205,571 | B1 * | 6/2012 | Rondeau et al. | 114/361 |

* cited by examiner

*Primary Examiner* — Justin Larson
(74) *Attorney, Agent, or Firm* — The Patent Guild; Paul Royal

(57) ABSTRACT

A height adjustable tower and cargo rack apparatus for wakeboard boats and the like, the apparatus including: a tower base rigidly attached to a boat gunwale, the tower base having a powered actuator; vertical supports extending from the tower base and pivotally operated by the powered actuator; a pivotally adjustable cargo rack apparatus supported by the vertical supports; and, a height adjustable upper tower section which is pivotally supported by the vertical supports and which adjustably supports the cargo rack apparatus. The multiplicity of adjustable and pivotal features work in conjunction with each other to maximize the unique functionality of the instant apparatus.

6 Claims, 13 Drawing Sheets

HEIGHT ADJUSTABLE TOWER AND CARGO RACK APPARATUS FOR WAKEBOARD BOATS

CROSS REFERENCE TO RELATED APPLICATIONS

This application is a Continuation-In-Part of U.S. patent application Ser. No. 11/711,282, filed Feb. 27, 2006 and issued as U.S. Pat. No. 8,025,194 on Sep. 27, 2011, which claims the benefit of U.S. Provisional Patent Application No. 60/777,060, filed Feb. 27, 2006 wherein both applications are incorporated by reference in their entirety as if fully set forth herein. Further, this application claims the benefit of U.S. Provisional Patent Application No. 61/363,259 filed Jul. 11, 2010, which claims the benefit of U.S. Provisional Patent Application Ser. No. 61/323,005, filed Apr. 12, 2010, wherein both provisional applications are incorporated by reference in their entirety as if fully set forth herein.

FIELD OF THE INVENTION

The present invention relates generally to boating equipment and accessories, and more particularly to an improved height adjustable tower and cargo rack apparatus for wakeboard boats and the like.

BACKGROUND OF THE INVENTION

It is a truism among boating enthusiasts that there is never enough storage room on a boat. This is particularly true in wakeboarding and related water sports, where the boater may need a place to store wakeboards, surfboards, wakesurf boards, tubes, inflatables, kayaks, accessories, and/or other sport cargo.

U.S. Pat. No. 6,192,819 to Larson, et al. discloses a water sport towing apparatus. U.S. Pat. No. 5,752,638 to Meeks describes a combination water ski and wake board rack. United States Patent Application 20020053313 by Murphy, et al. teaches a shade cover assembly adapted to be carried on a tower above the cockpit area of a pleasure boat.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

SUMMARY OF THE INVENTION

Revise Summary of the Invention Info Iaw Detailed Info

Disclosure of Invention

The present invention provides an improved height adjustable tower and cargo rack apparatus for wakeboard boats and the like. The inventive apparatus enables the adjustability of the height of the cargo rack/bimini which is accomplished by lowering or raising the lower tower section with an actuator, gas spring, or tensioner cable after releasing a locking mechanism. The range in height would be approximately 20", adjustable from 50" to 70" as measured at the front of the rack to the floor of the boat. The benefit to the user is the ability to control the amount of shade/sun for the people in the general cockpit area. It also allows a user to achieve a higher walk-through height for ease of maneuvering in the boat. Generally there is a trade off between the amount of sun coverage and height of the bimini portion of the rack. This feature allows the user to easily adjust the height to his/her liking.

It is therefore an object of the present invention to provide a new and improved height adjustable tower and cargo rack apparatus for wakeboard boats and the like.

Other novel features which are characteristic of the invention, as to organization and method of operation, together with further objects and advantages thereof will be better understood from the following description considered in connection with the accompanying drawing, in which preferred embodiments of the invention are illustrated by way of example. It is to be expressly understood, however, that the drawing is for illustration and description only and is not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the national patent office(s) and the public generally, and especially the scientists, engineers and practitioners in the art who are not familiar with patent or legal terms or phraseology, to determine quickly from a cursory inspection the nature and essence of the technical disclosure of the application.

The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE DRAWINGS

The invention will be better understood and objects other than those set forth above will become apparent when consideration is given to the following detailed description thereof. Such description makes reference to the annexed drawings, wherein.

DETAILED DESCRIPTION OF THE PREFERRED EMBODIMENTS

As disclosed herein, essential elements of the height adjustable tower and cargo rack apparatus include, but are not limited to: a tower base rigidly attached to a boat gunwale, the tower base having a powered actuator; vertical supports extending from the tower base and pivotally operated by the powered actuator; a pivotally adjustable cargo rack apparatus supported by the vertical supports; and, a height adjustable upper tower section which is pivotally supported by the vertical supports and which adjustably supports the cargo rack apparatus. As described below, the multiplicity of adjustable and pivotal features work in conjunction with each other to maximize the unique functionality of the instant apparatus.

While the preferred cargo rack apparatus is presented herein, it is understood alternate embodiments may encompass cargo racks differently configured or bimini tops (such as collapsible or welded frame bimini tops) as generally used within the industry. While these alternate cargo rack apparatus embodiments may present elements of the instant invention, it is understood that they are not necessarily the equivalent to the cargo rack of the preferred embodiment of the instant invention or of the height adjustable tower and cargo rack apparatus of the instant invention.

Height Adjustable Tower

As shown at least in FIG. 1-20, the height adjustable tower and cargo rack apparatus 100 includes at least one wakeboard tower 114 and tower mount 190 wherein the tower mount 190 is pivotally connected to a tower base 195.

Figure 1:
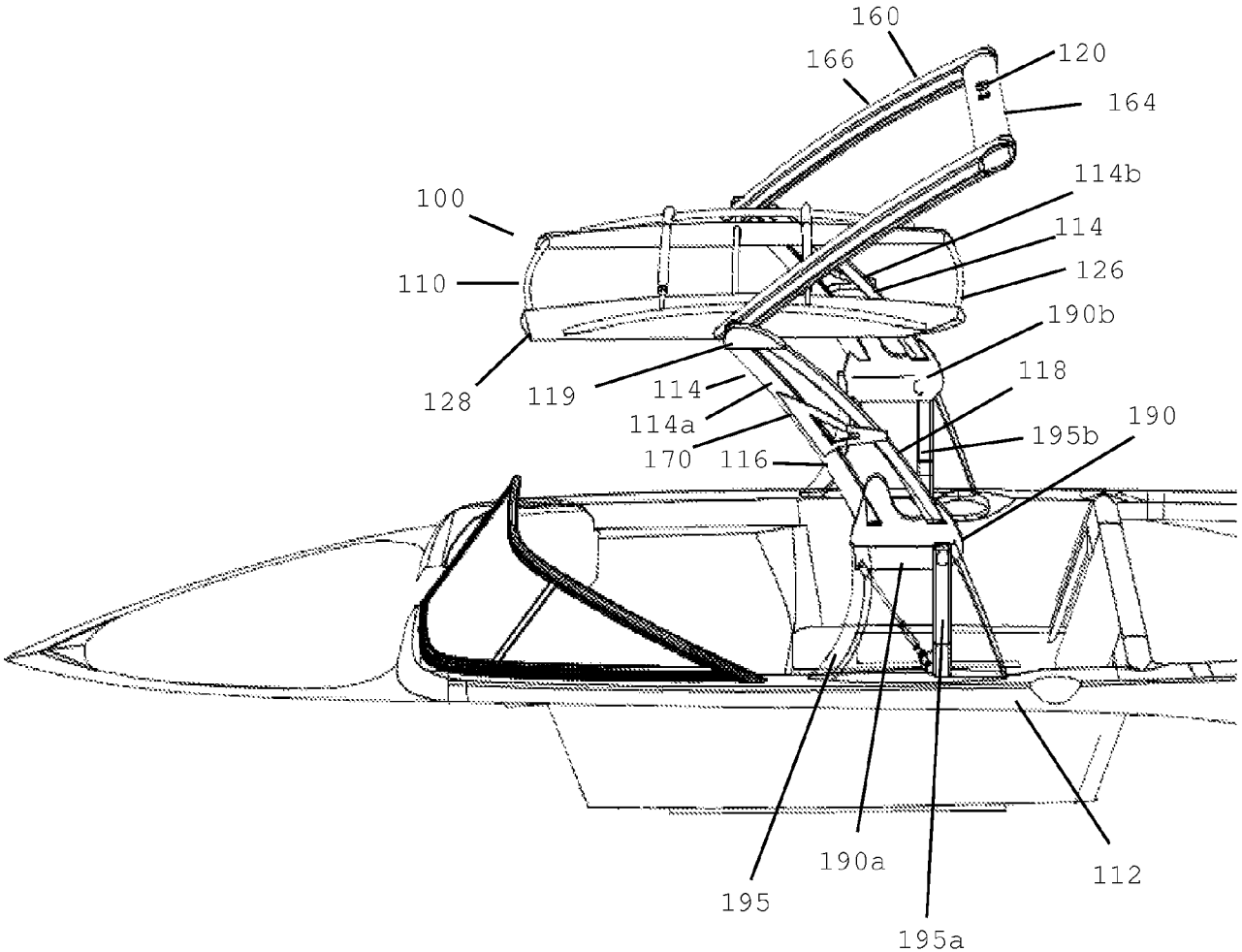
FIG. 1 is an upper side view of the height adjustable tower and cargo rack apparatus on a boat.

As shown in FIG. 1, the preferred embodiment of the present invention includes a wakeboard tower 114 connected to a tower mount 190 which is connected to a tower base 195*a* which itself is connected to a boat 112 gunwale at the port side of the boat and a wakeboard tower 114 connected to a tower mount 190 which is connected to a tower base 195*b* which itself is connected to a boat 112 gunwale at the starboard side of the boat.

Whereas tower bases 195*a*, 195*b*, tower mounts 190*a*, 190*b*, and towers 114*a*, 114*b* are respectively symmetrical with the exception that they are designed for their specific port or starboard location on the boat, within the present application they are respectively designated tower base 195, tower mount 190, and tower 114 unless noted otherwise.

Figure 2:
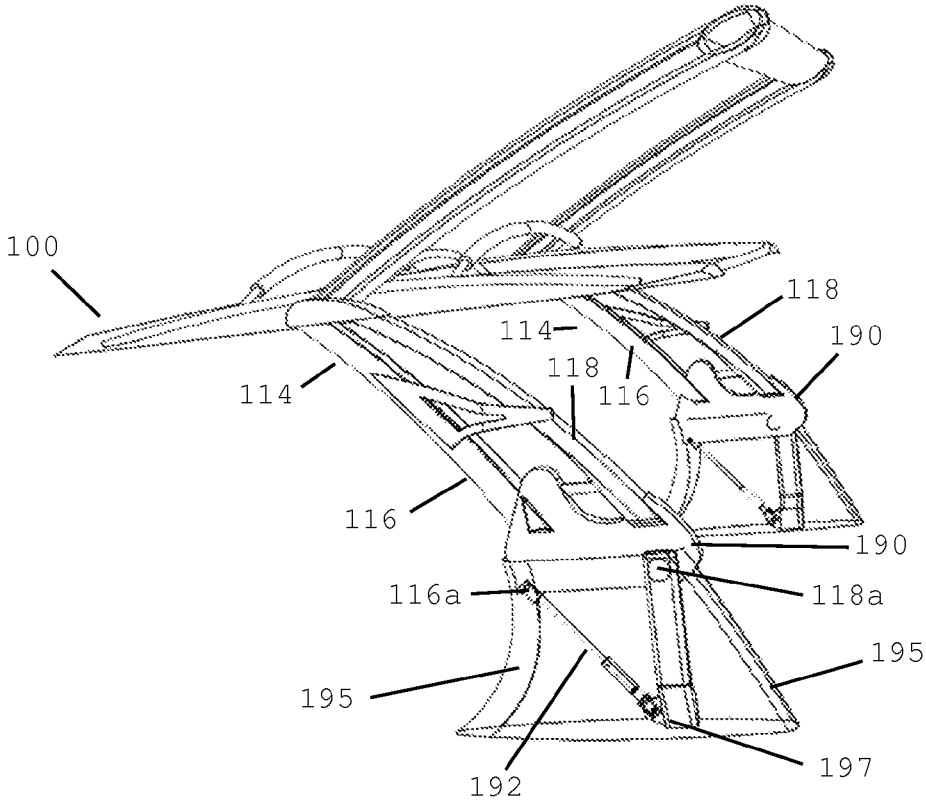
FIG. 2 is lower side view of the height adjustable tower and cargo rack apparatus.
Figure 3:
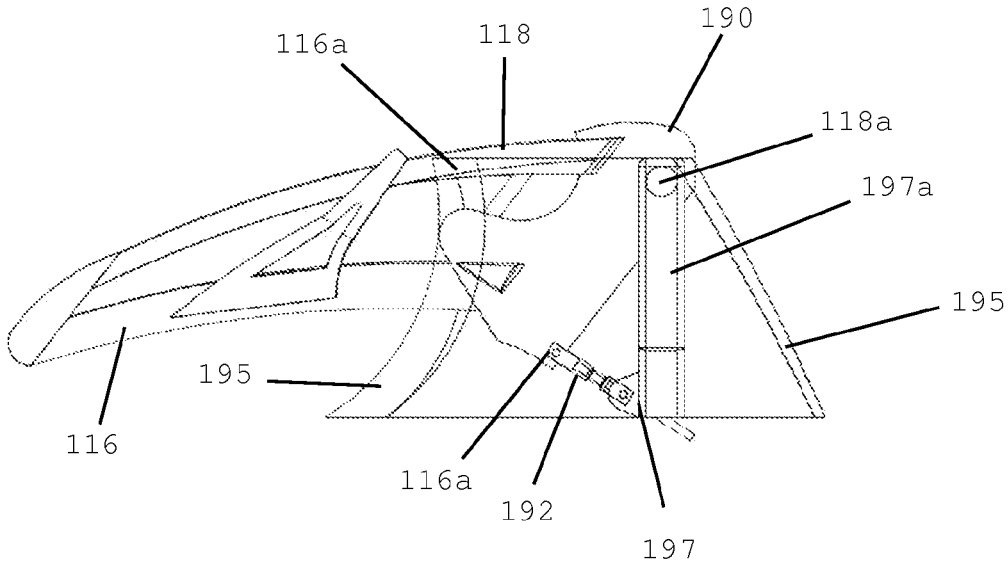
FIG. 3 is a folded view of the wakeboard tower, tower mount, and tower base.
Figure 4:
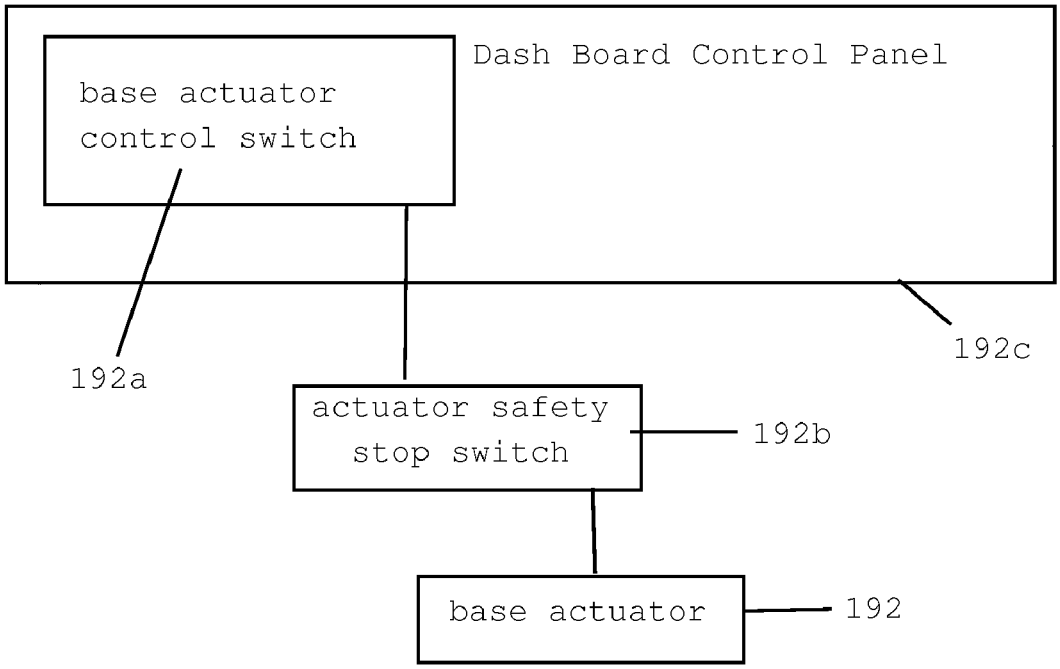
FIG. 4 is the base actuator control diagram.

As shown in FIG. 2 and FIG. 3, each wakeboard tower 114 includes a forward vertical support 116 pivotally connected to the tower mount 190 at pivot joint 116*a*, and an aft vertical support 118 which is pivotally connected to both the upper rear of the housing of tower base 195 and to tower mount 190 at aft pivot joint 118*a*.

As shown at least in FIG. 1, the wakeboard towers 114 further includes a vertical support connector 170 interconnecting the forward vertical support 116 to the aft vertical support 118.

As shown in FIG. 2 and FIG. 3, the tower base 195 further includes a base actuator 192 extendably and retractably attached at a base actuator first end at pivot joint 116*a* positioned at the fore portion of the lower portion of tower mount 190 and at a base actuator second end to the tower base aft lower portion 197. Tower base 195 further includes a tower base support, 197*a* extending from the tower base lower portion to the tower base upper portion. FIG. 2 shows the base actuator 192 in an extended position and FIG. 3 shows the base actuator in a retracted position with the wakeboard tower 114 respectively shown un-tilted and tilted in correspondence with the position of the base actuator 192. The base actuator 192 of the preferred embodiment is an electromechanical actuator however it is understood the actuator may, for alternative embodiments, be of an alternative type such as a hydraulic actuator, a electro-hydraulic, a pneumatic actuator, a electro-pneumatic actuator, or gas spring, or similar displacement producing component.

The tower base 195 also includes a base locking mechanism 194, as shown at least in FIG. 6, and FIGS. 6*a*-17. The base locking mechanism 194 includes a base locking mechanism inboard support housing 200 attached to the tower mount 190 at the aft pivot joint 118*a* which therefore allows the tower mount 190 to rotate with respect to the tower base 195; a base locking mechanism cam lever 205; a base locking mechanism clamp threaded adjuster knob 210; a base locking mechanism spline 215 having a plurality of spline teeth 215*a* and a plurality of base locking mechanism pin holes 215*b*; a plurality of base locking mechanism pins 220; a base locking mechanism main shaft 230; a base locking mechanism adjuster bolt 240; a base locking mechanism clamp plate 250 having a plurality of base locking mechanism clamp plate indentions 250*a*; a plurality of base locking mechanism bearings 265; a plurality of base locking mechanism springs 270; a plurality of base locking mechanism washers 285; a base locking mechanism fastener 287, a base locking mechanism cam lever pin 289, and a base locking mechanism outboard support housing 290 for attachment to the tower base 195, the base locking mechanism outboard support housing 290 including a plurality of housing teeth 290*a*. The junction of the base locking mechanism inboard support housing 200 and the base locking mechanism outboard support housing 290 establish the aforementioned aft pivot joint 118*a*.

A unique feature of the base locking mechanism 194 is that it can be unlocked to allow the tower 114 to be tilted about aft pivot joint 118*a* and re-locked once the tower 114 is in the desired position.

With the base locking mechanism 194 assembled as shown in FIGS. 6-17, in the unlocked base position the base locking mechanism cam lever 205 is positioned to allow the free rotation of the base locking mechanism inboard support housing 200 with respect to the base locking mechanism outboard support housing 290.

Figure 6A:
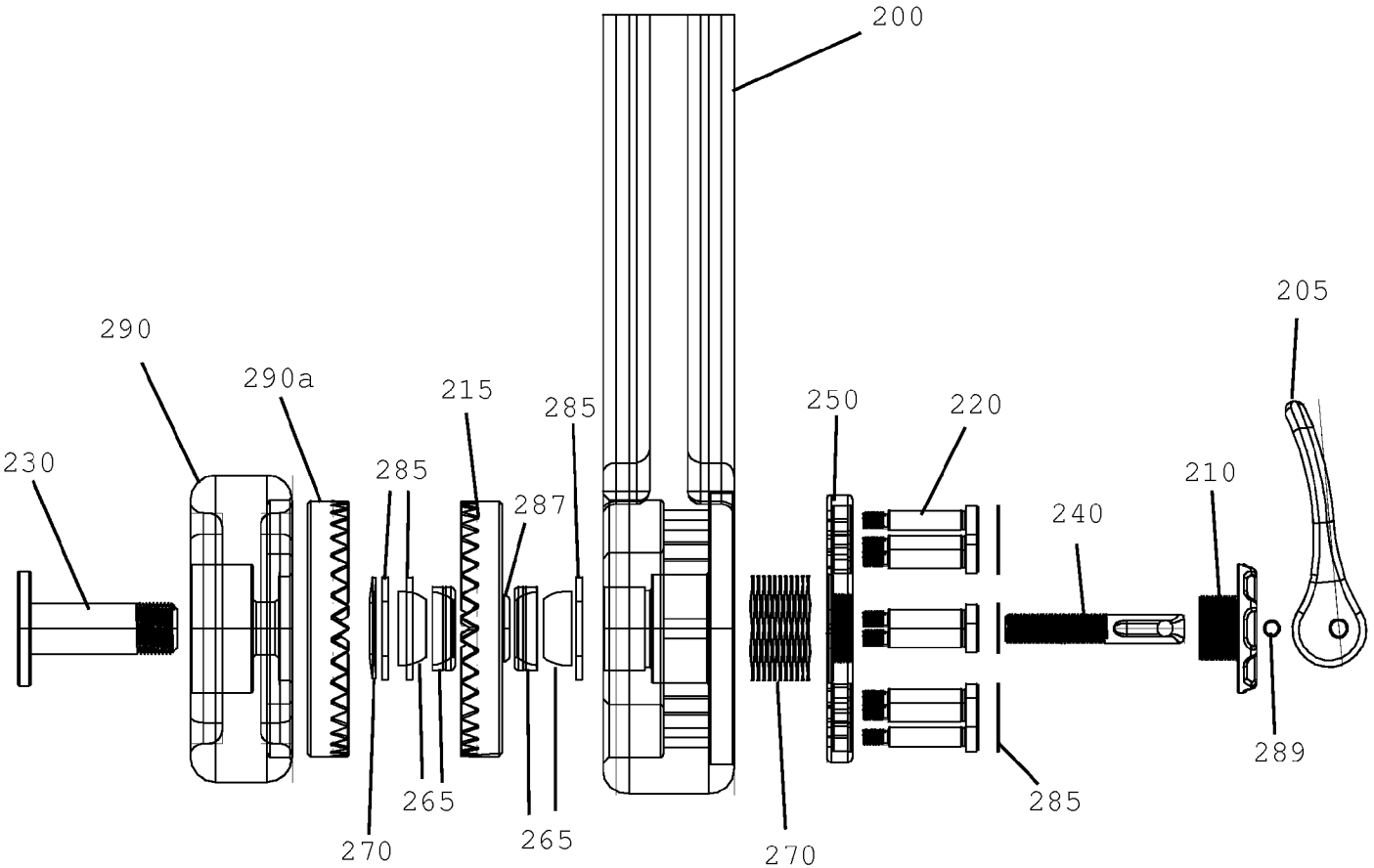
FIG. 6*a* is an exploded view of the base locking mechanism.
Figure 6:
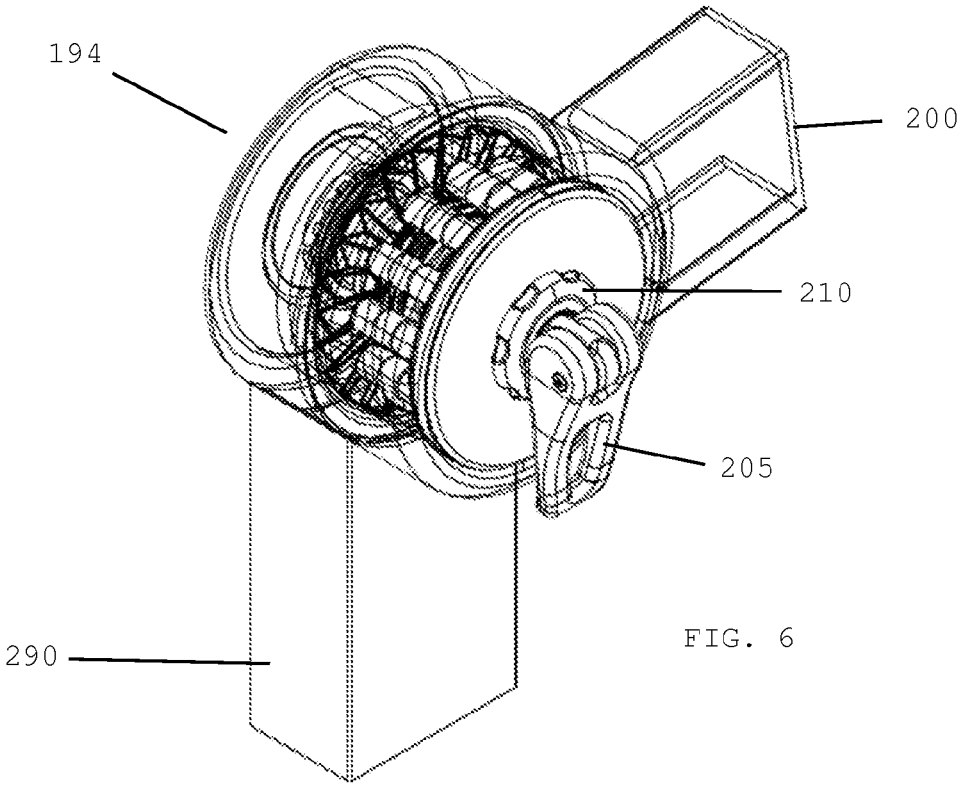
FIG. 6 is an upper side wireframe view of the base locking mechanism.
Figure 7:
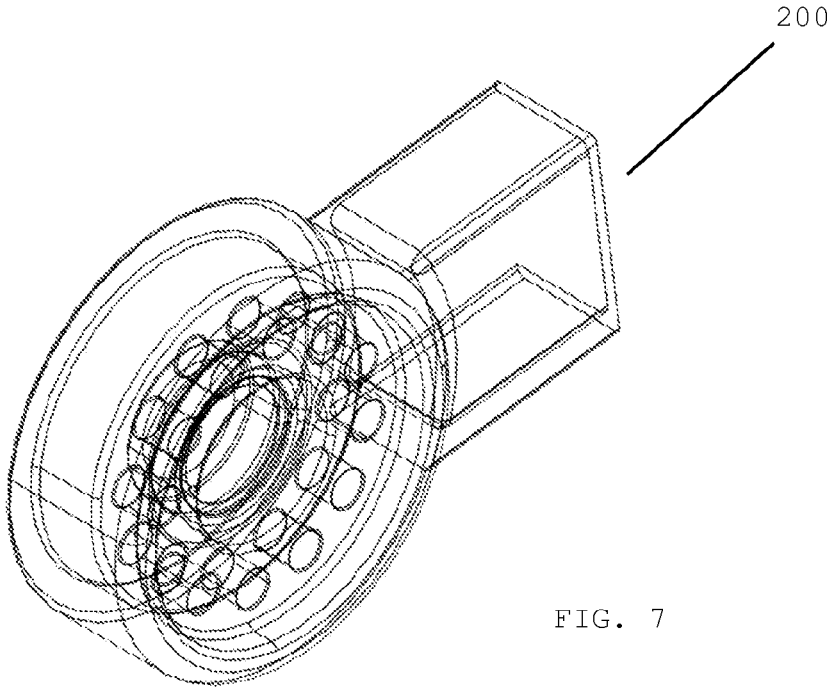
FIG. 7 is an upper side wireframe view of the inboard support housing of the base locking mechanism.
Figure 8:
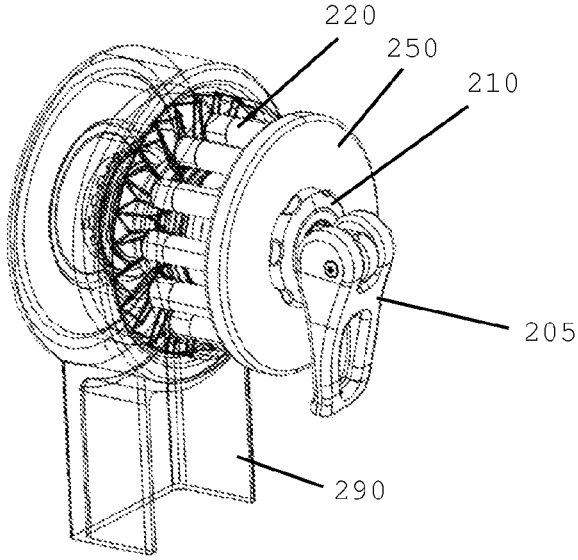
FIG. 8. is a wireframe view of some of the components of the base locking mechanism.
Figure 9:
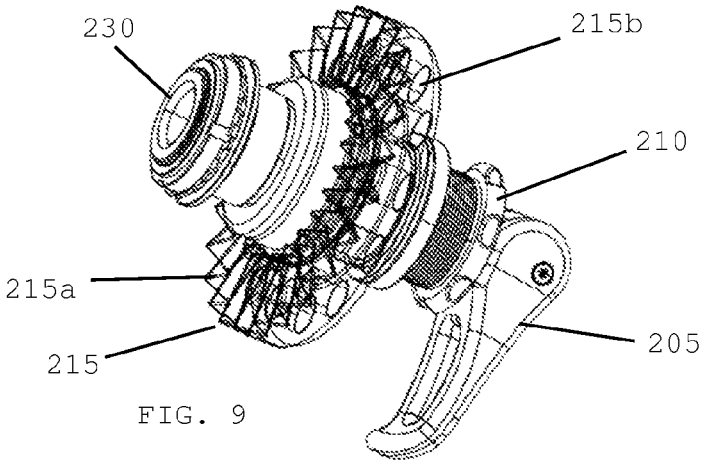
FIG. 9. is a wireframe view of some of the components of the base locking mechanism.
Figure 10:
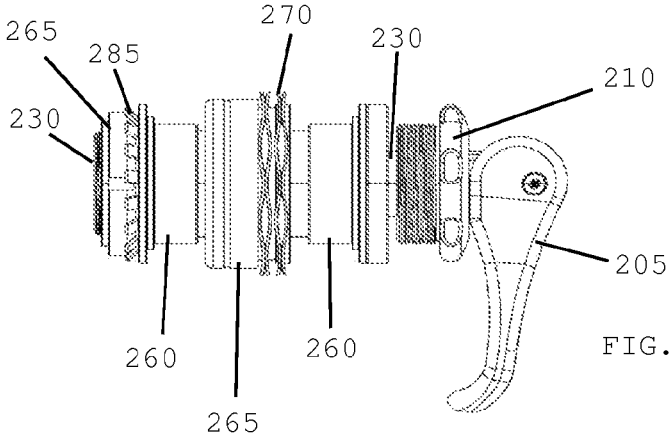
FIG. 10. is a side view of some of the components of the base locking mechanism.
Figure 11:
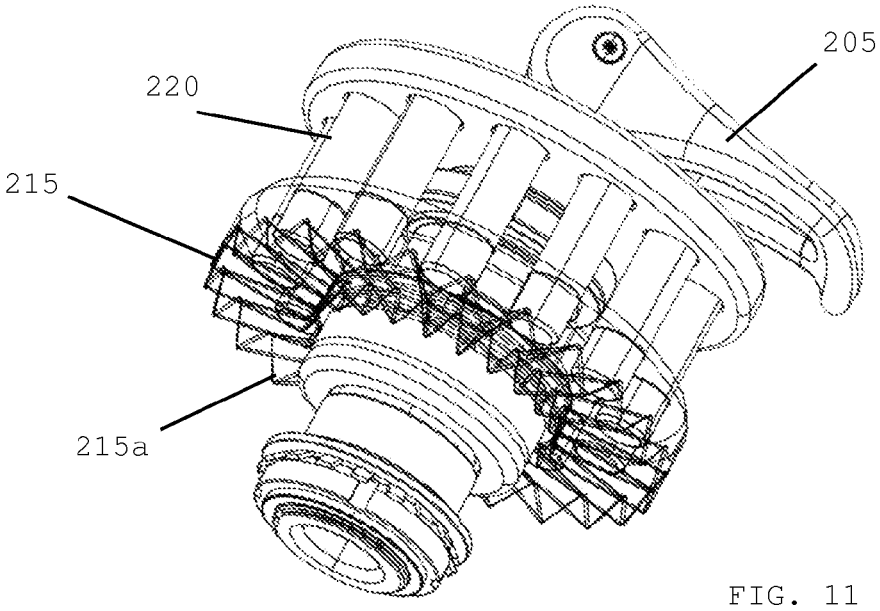
FIG. 11. is a wireframe view of some of the components of the base locking mechanism.
Figure 12:
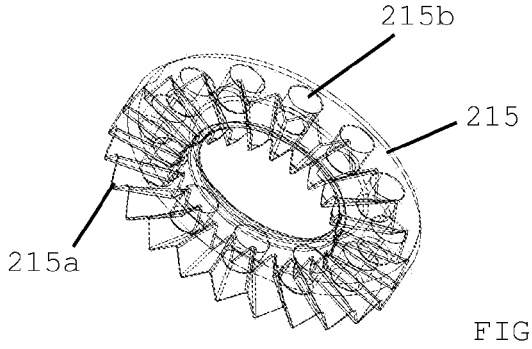
FIG. 12. is a lower side wireframe view of the base locking mechanism spline.
Figure 13:
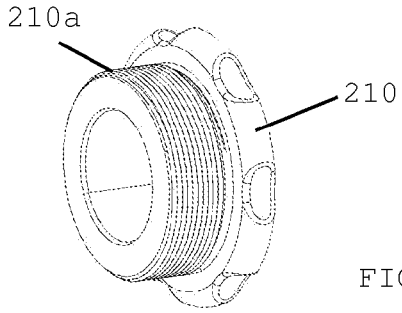
FIG. 13. is an isometric view of the base locking mechanism spline adjuster knob.
Figure 14:
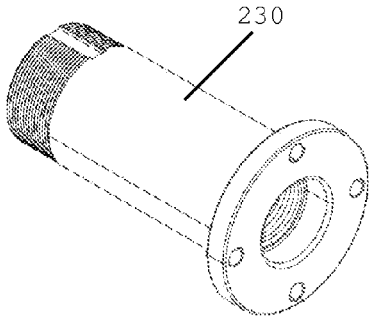
FIG. 14. is an isometric view of the base locking mechanism adjuster bolt.
Figure 15:
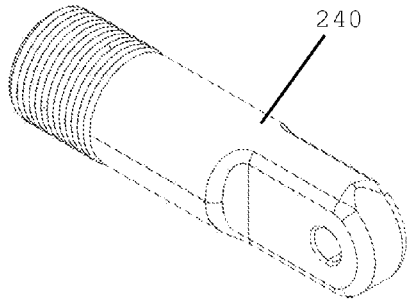
FIG. 15. is an isometric view of the base locking mechanism spline adjuster knob.
Figure 16:
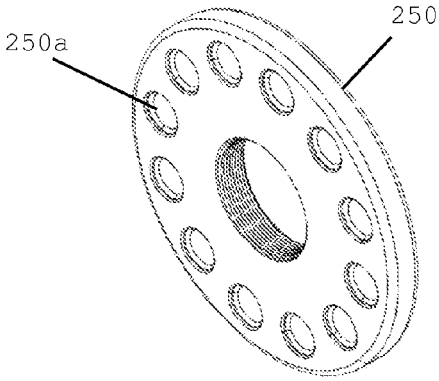
FIG. 16. is an isometric back view of the base locking mechanism clamp plate with a plurality of indentions.
Figure 17:
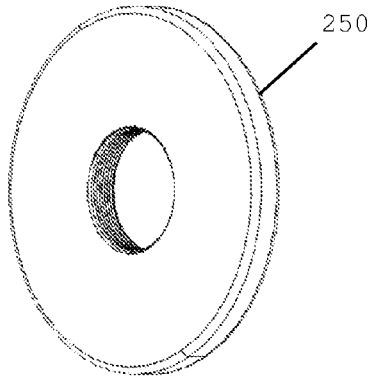
FIG. 17. is an isometric front view of the base locking mechanism clamp plate.

In the unlocked position, within the base locking mechanism 194 the base locking mechanism spline teeth 215*a* are held apart from the base locking mechanism outboard support housing teeth 290*a* thereby allowing the rotation of the tower 114 through out a range of positions including fully extended to fully retracted or stowed. The interacting surface areas provided by the base locking mechanism outboard support housing teeth 290*a* and the base locking mechanism spline teeth 215*a* imbue the instant invention with the ability to withstand extreme loading conditions such as when the boat is towing a wakeboarder. Further, the spline teeth configuration, in conjunction with the base locking mechanism bearings 265 and unique base locking mechanism 194 assemblage as shown in FIG. 6*a* provides the height adjustable tower and cargo rack apparatus 100 with robust and distinctive wakeboader towing capacity.

In the locked base position the locking mechanism cam lever 205 is positioned to prohibit the free rotation of the locking mechanism inboard support housing 200 with respect to the base locking mechanism outboard support housing 290.

In the locked position, within the base locking mechanism 194 the locking mechanism spline teeth 215*a* are held against the outboard support housing teeth 290*a* thereby preventing rotation of the locking mechanism inboard support housing 200 with respect to the base locking mechanism outboard support housing 290 and thereby preventing rotation of the tower 114.

Tower Height Adjustment Operation

FIGS. 2, 3, and 5A thru 5F show the operation of the height adjustable tower and cargo rack apparatus 100 from the fully extended position to the retracted and stowed position. When the wakeboard towers 114 are in the maximum upright position, the upper ends of the wakeboard towers 114 are at their furthest distance from the gunwale of the boat 112. The base locking mechanism 194 of the tower base 190 is locked to hold the wakeboard towers 114 in the maximum upright position.

With the release of the base locking mechanism 194 on each of the two tower bases 195 the lower section of each tower 114 can be pivoted about aft pivot joint 118*a* to allow each tower 114 to tilt forward and downward towards the gunwale of the boat 112.

The movement of the lower section of each tower 114 is determined by operation of the base actuator 192 which is controlled via a base actuator control switch 192*a*. The base actuator control switch 192*a* includes operating functions which allow the bi-directional unison incremental tilting of the towers 114 as well as the bi-directional unison tilting of the towers 114 to preset height positions.

The base actuator control switch 192*a* switch is provided either on the tower base 195, a dashboard control panel 192*c* of the boat 112, or at a location most suitable for boat users.

The base actuator 192 is connected to a base actuator safety stop switch 192*b* which cuts power to the base actuator 192 in the event that there is a person or persons in the area that the towers 114 moves. The base actuator safety stop switch 192*b* is provided either on the tower base 195, the dashboard control panel 192*c* of the boat 112, or at a location most suitable for boat users. The base actuator safety stop switch 192*b* may be one or more simple "kill" switches or one or more proximity switches which electrically sense the presence of a person or object.

The placement of the aft pivot point 118*a* at the upper rear of the tower base 195, as shown in at least in FIG. 2 and FIG. 3, is an essential element in the pivotal movement of the tower 114. This optimized location of aft pivot point 118*a* allows the vertical support 116 to pivot down with minimal forward movement of the overall cargo rack apparatus 110. The bottom portion of the lower section of each tower 114 lowers into the housing of the respective tower base 195 when the tower 114 is folded down.

Height Adjustable Cargo Rack

As shown at least in FIG. 1 the height adjustable tower and cargo rack apparatus of the instant invention further includes a cargo rack apparatus 110 supported by the upper ends of both the forward vertical support 116 and the aft vertical support 118 near a midsection 119 of each tower 114.

As also shown at least in FIGS. 1-4, the height adjustable tower and cargo rack apparatus 100 further includes an upper tower section 160 supported by the upper ends of both the forward vertical support 116 and the aft vertical support 118 near the midsection 119 of each tower 114.

Figure 19:
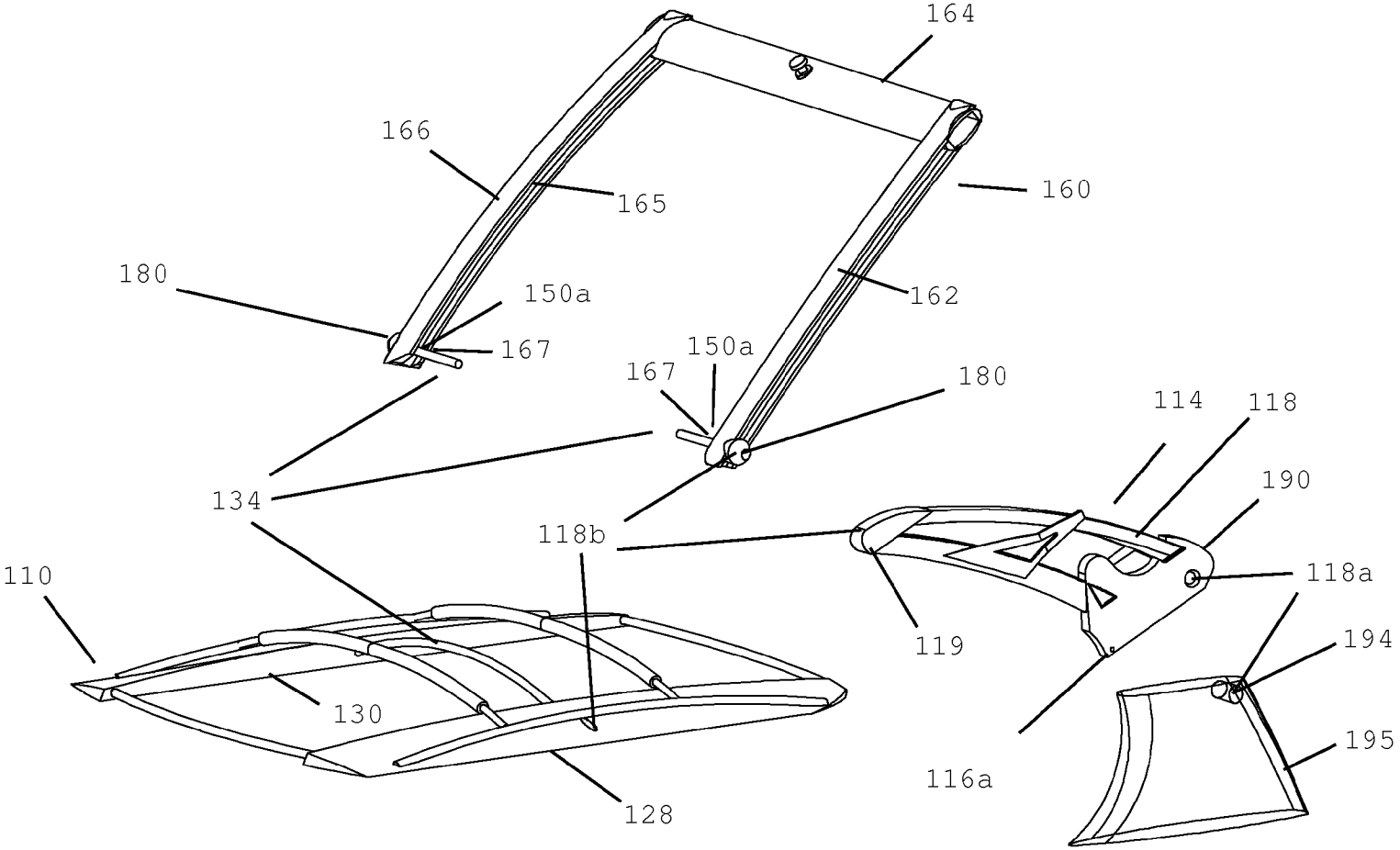
FIG. 19 provides a view of the key pivoting elements and pivoting locations.

As shown in FIG. 19, the upper tower section 160 includes interconnected peripheral rails defining an upper tower section port side wall 162, an upper tower section back wall 164, and an upper tower section starboard side wall 166. Both the upper tower section port side wall 162 and the upper tower section starboard side wall 166 include a channel area 165 provided along at least a portion of their length. A socket 150*c* is positioned within the side wall channel areas 165.

As shown at least in FIG. 19, the cargo rack apparatus 110 is pivotally and adjustably attached to each tower midsection 119 at a releasable pivot joint 167 and at least one adjustable strut 168 as further describe herein.

Figure 20A:
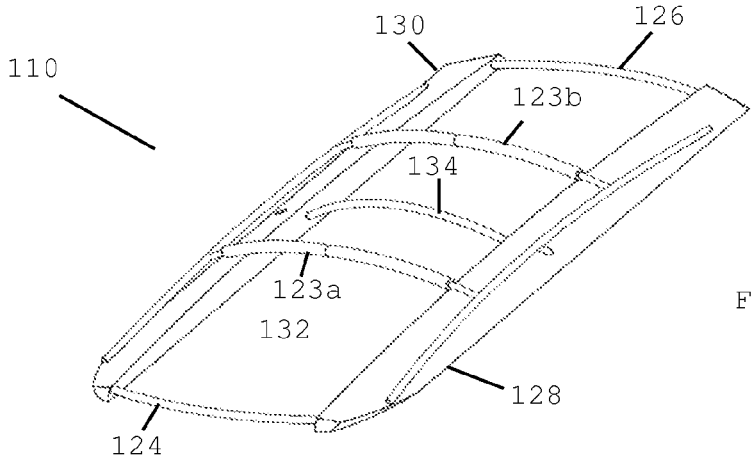
FIG. 20*a* is a top isometric view of the cargo rack.
Figure 20B:
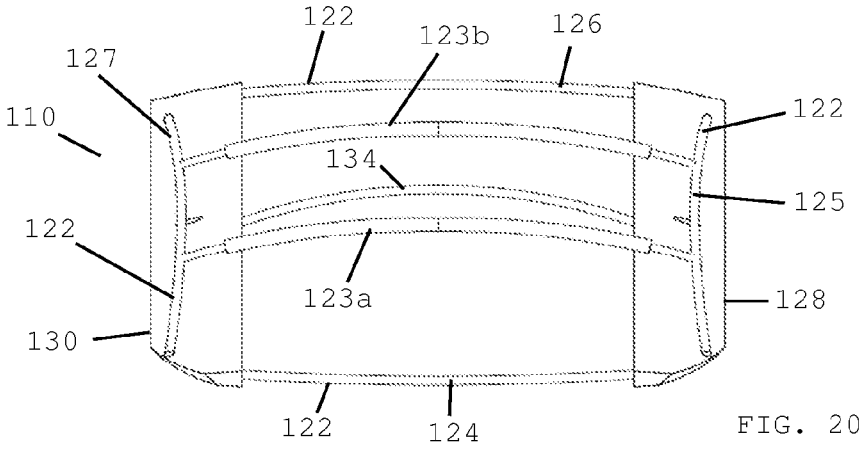
FIG. 20*b* is a front view of the cargo rack.
Figure 20C:
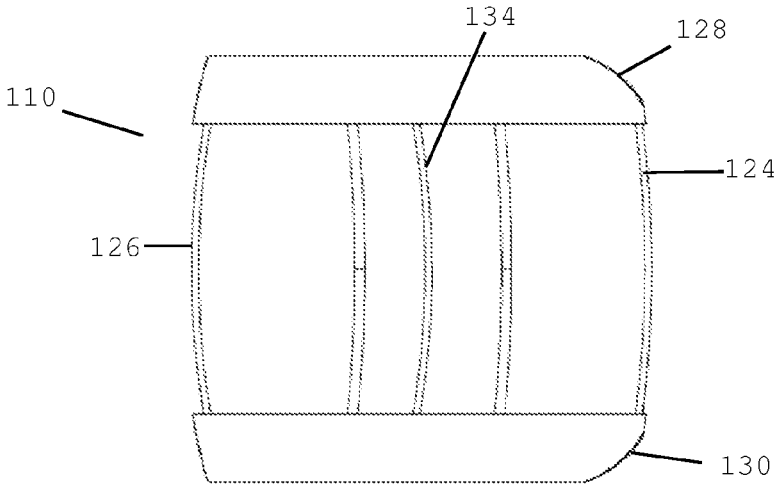
FIG. 20*c* is a bottom view of the cargo rack.

As shown at least in FIGS. 20*a*, 20*b*, and 20*c*, the cargo rack apparatus 110 includes a cargo rack apparatus interior volume 132, and one or more connected peripheral rails 122 including a cargo rack fore interconnecting rail 123*a*, a cargo rack aft interconnecting rail 123*b*, a cargo rack apparatus front rail 124, a cargo rack apparatus port side rail 125, a cargo rack apparatus back rail 126, a cargo rack apparatus starboard side rail 127. Cargo rack apparatus 110 further includes port side wall support 128 and starboard side wall support 130.

Cargo rack apparatus 110 further includes crossmember 134, wherein the fore interconnecting rail 123*a*, the aft interconnecting rail 123*b*, and crossmember 134 interconnect opposing side walls 128, 130 and also cooperate to provide a support surface for stored items.

Crossmember 134 is a tubular component which includes a connector ball 150*a* extending from each end of the tube. The connector ball 150*a* is secured by a removable pin 150*b* to the socket 150*c* which has been positioned in each side wall channel area 165*a*. The combination of the connector ball 150*a*, removable pin 150*b*, and socket 150*c* forms the releasable pivot joint 167.

As the cargo rack apparatus 110 is tilted the connector balls 150*a* on the ends of crossmember 134 translated along channel areas 165 of the upper tower section side walls 162 and 166 thereby allowing the cargo rack apparatus 110 to move forward and aft of the tower midsection 119 as well as tilt up or down.

The upper tower section port side wall 162 and the upper tower section starboard side wall 166 are adjustably attached to each respective tower midsection 119 at fore pivot joint 118*b* via the respective cam-lever locking mechanism 180 as further described below.

The cam-lever locking mechanism 180, as shown in FIG. 19 has essentially the same core elements as the base locking mechanism 194 with the key difference being that the cam-lever locking mechanism 180 pivotally and lockably connects the tower midsection 119 to the upper tower section port side wall 162 and the upper tower section starboard side wall 166 at fore pivot joint 118*b*, whereas the base locking mechanism 194 pivotally and lockably connects the tower mount 190 (which supports the pivoting aft tower vertical support 118 lower end) to the upper rear of tower base 195 at aft pivot joint 118*a*.

Figure 18:
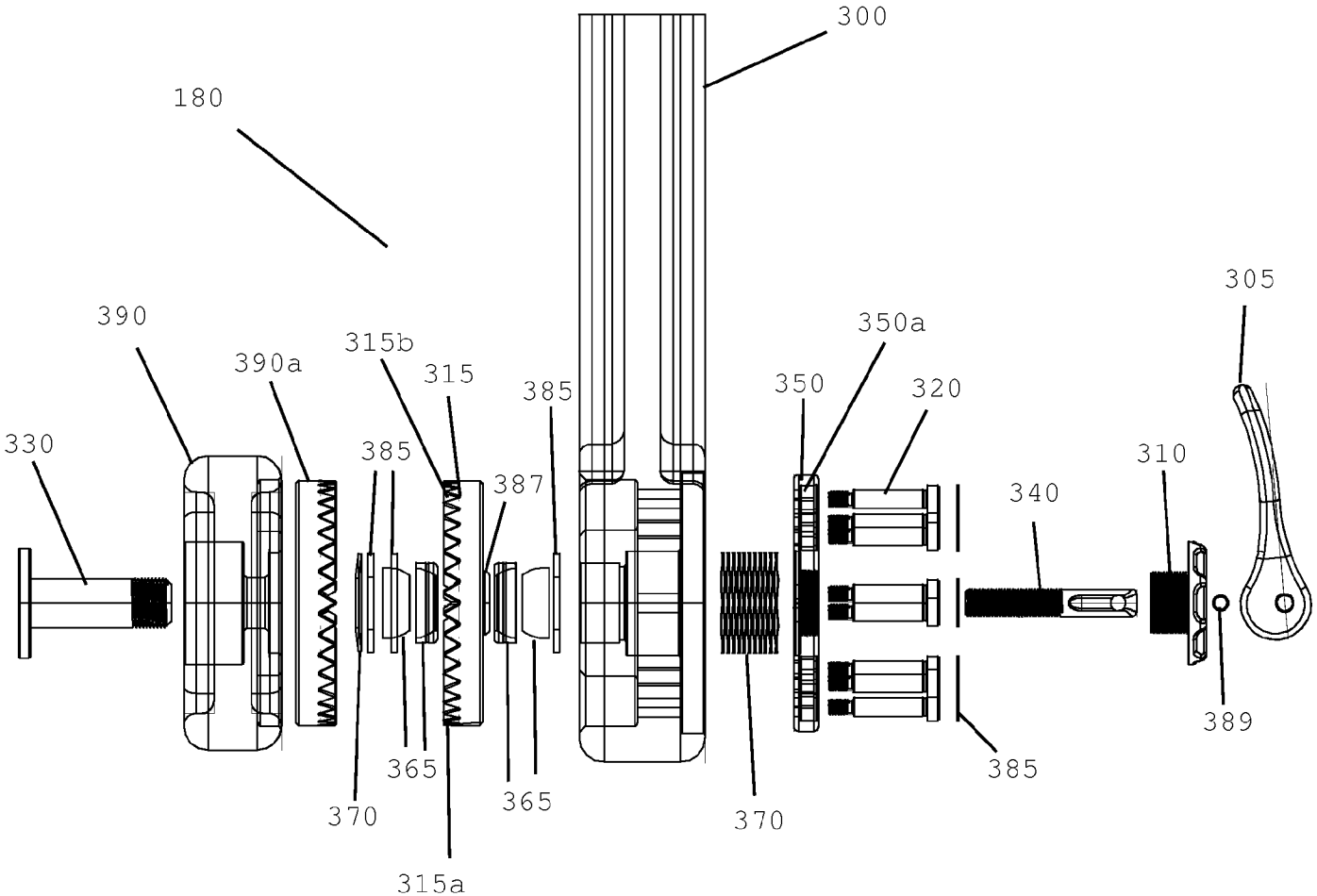
FIG. 18 is an exploded view of the cam-lever locking mechanism.

As shown in FIG. 18, cam-lever locking mechanism 180 includes a locking mechanism inboard support housing 300 which is attached to the tower midsection 119 at the fore pivot joint 118*b*. Cam-lever locking mechanism 180 also includes a locking mechanism outboard support housing 390 which is attached to applicable upper tower section port side wall 162 and the upper tower section starboard side wall 166, the locking mechanism outboard support housing 390 including a plurality of housing teeth 390*a*.

Cam-lever locking mechanism 180 further includes a locking mechanism cam lever 305 (which locks and unlocks the rotation or tilting of upper tower section 160); a locking mechanism clamp threaded adjuster knob 310; a locking mechanism spline 315 having a plurality of spline teeth 315*a* and a plurality of locking mechanism pin holes 315*b*; a plurality of locking mechanism pins 320; a locking mechanism main shaft 330; a locking mechanism adjuster bolt 340; a locking mechanism clamp plate 350 having a plurality of locking mechanism clamp plate indentions 350*a*; a plurality of locking mechanism bearings 365; a plurality of locking mechanism springs 370; and a plurality of locking mechanism washers 385.

The cam-lever locking mechanism 180 is assembled as shown in the exploded view of FIG. 18.

The intersecting plane and interconnection formed by each tower's midsection 119, aligned with crossmember 134, the upper tower section port side wall 162 and the upper tower section starboard side wall 166, and the cam-lever locking mechanisms 180 of each tower establishes the position of a pair of coplanar fore pivot points 118*b*, as shown at least in FIG. 19 (note only 1 fore pivot point 118*b* and aft pivot point 118*a* is shown with respect to one tower 114 and it is understood the corresponding tower 114 not shown provides a corresponding second fore pivot point 118*b* and a corresponding second aft pivot 118*a*).

With the cam-lever locking mechanism 180 assembled as shown at least in FIG. 18, in the unlocked position the cam-lever locking mechanism cam lever 305 is positioned to allow the free rotation of the locking mechanism inboard support housing 300 with respect to the cam-lever locking mechanism outboard support housing 390. This allows the cargo rack apparatus 110 as connected to outboard support housing 390 via the upper tower section port side wall 162 and the upper tower section starboard side wall 166 to rotate with respect to the tower 114 as connected to inboard support housing 300.

In the unlocked position, within the cam-lever locking mechanism 180 the cam-lever locking mechanism spline teeth 315*a* are held apart from the cam-lever locking mechanism outboard support housing teeth 390*a* thereby allowing the rotation of the upper tower section 160 through out a range of rake positions. The interacting surface areas provided by the cam-lever locking mechanism outboard support housing teeth 390*a* and the cam-lever locking mechanism spline teeth 315*a* imbue the instant invention with the ability withstand extreme loading conditions such as when the boat is towing a wakeboarder. Further, the spline teeth configuration, in conjunction with the of cam-lever locking mechanism bearings 360 and unique cam-lever locking mechanism 180 assemblage as shown in FIG. 18 provides the height adjustable tower and cargo rack apparatus 100 with robust and distinctive wakeboader towing capacity.

In the unlocked position, within the cam-lever locking mechanism 180 the locking mechanism spline teeth 315*a* are held apart from the outboard support housing teeth 390*a* thereby allowing the rotation of the upper tower section 160 through out a range of positions.

In the locked position the cam-lever locking mechanism 180 is positioned to prohibit the free rotation of the locking mechanism inboard support housing 300 with respect to the base locking mechanism outboard support housing 390.

In the locked position, within the cam-lever locking mechanism 180 the locking mechanism spline teeth 315*a* are held against the outboard support housing teeth 390*a* thereby preventing rotation of the cam-lever locking mechanism inboard support housing 300 with respect to the cam-lever locking mechanism outboard support housing 390 and thereby preventing rotation of the upper tower section 160.

Cargo Rack Height Adjustment Operation

The cargo rack apparatus 110 adjustably pivots upward and downward about the fore pivot points 118*b* thereby providing a variation in the height of the cargo rack apparatus' front wall 124 and back wall 126.

The fore and aft as well as upward and downward rake motion range of the cargo rack apparatus 110 provides the ability to adjust the effective height of the cargo rack apparatus 110 which allows user to control the amount of coverage from the harmful rays of the sun which can cause skin cancer or to protect boaters from wind and rain. Further, this unique range of movement of the cargo rack apparatus 110 allows users to adjust the bow-to-stern walk-through height as desired.

The tilting of the lower section of each tower 114 controls the height of the cargo rack apparatus 110. As shown in FIGS. 5A through 5F the tilting of the cargo rack apparatus 110 can be adjusted in coordination with the tilting of the tower 114 or the cargo rack apparatus 110 can be tilted independently of the tilting of the tower 114.

Height Adjustable Tow Point

A ski tow 120 is provided on the upper tower section back wall 164.

The upper tower section 160 further includes at least one upper tower section adjustable strut 168 adjustably connecting at least one peripheral rail to the cargo rack apparatus 110.

In the preferred embodiment of the instant invention an upper tower section adjustable strut 168 adjustably connects the upper tower section port side wall 162 to the cargo rack apparatus peripheral rail port side wall 128 and an upper tower section adjustable strut 168 adjustably connects the upper tower section starboard side wall 166 to the cargo rack apparatus peripheral rail starboard side wall 130.

The upper tower section port side wall 162 and the upper tower section starboard side wall 166 are both connected to the cam-lever locking mechanism 180 at respective forward pivot points 118*b*.

Tow Point Height Adjustment Operation

With the release of cam-lever locking mechanism 180 at forward pivot points 118*b* the upper tower section side walls 162, 166 of the tower can be raised and lowered, which in effect changes the height of the ski tow 120 and consequently changes the height a tow rope (not shown) attached to the ski tow 120 and thereby adjusts the towing point height.

The benefit of the tow point being at the maximum height position is that it gives the wake boarder the ability to get higher in the air when doing maneuvers that require the use of the wake of the boat to get lift (i.e. jumping the wake or flips). The benefit of the tow point being in the minimum height position is that the center of gravity of the tow point is lower for pulling one or more inflatable tubes. When pulling a tube where the goal of a session is to give the tuber a wild ride, there is increased strain on the complete tower structure. With multiple tubes that have two or three riders on each tube this strain is amplified. There are towers on the market that warn against pulling a tube from the tow point at all. When a tube or tubes are pulled from the tower tow point there have been numerous cases of the welds on the tower breaking. By lowering the center of gravity of the tow point this strain is reduced. Also, with the lower tow point there is less "rock of the boat from side to side" than when pulled from the higher tow points.

Further Operation Using the Adjustable Strut

The upper tower section adjustable struts 168 also adjustably allows for the adjustment of the rake or angle of the cargo rack apparatus 110 with respect to the upper tower section 160 and its interconnected peripheral rails.

This adjustability allows, for example, the boater to position the tow point (120) at the maximum height position so that wake boarders get higher in the air when doing maneuvers while also positioning the cargo rack apparatus 110 in the lowest position with the front wall 124 closest to the boat deck to simultaneously provide boat passengers maximum coverage from the sun, wind, and rain thereby enhancing the boating experience for all participants.

Figure 5A:
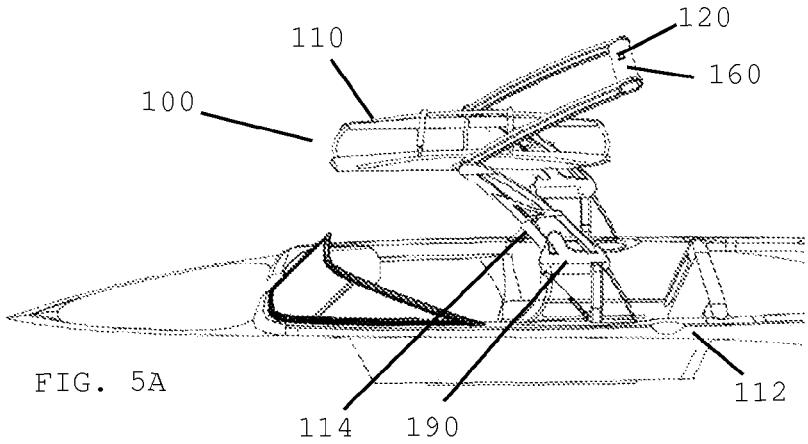
FIG. 5A shows the height adjustable tower and cargo rack apparatus fully extended.
Figure 5B:
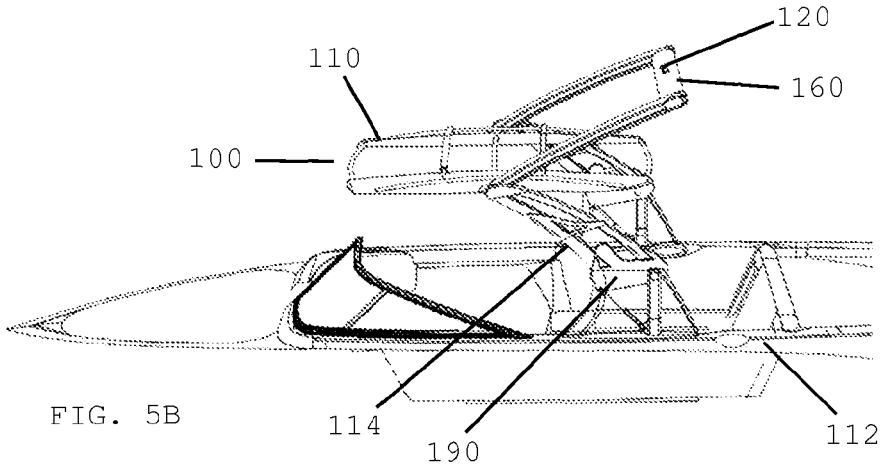
FIG. 5B shows the height adjustable tower and cargo rack apparatus partially extended.
Figure 5C:
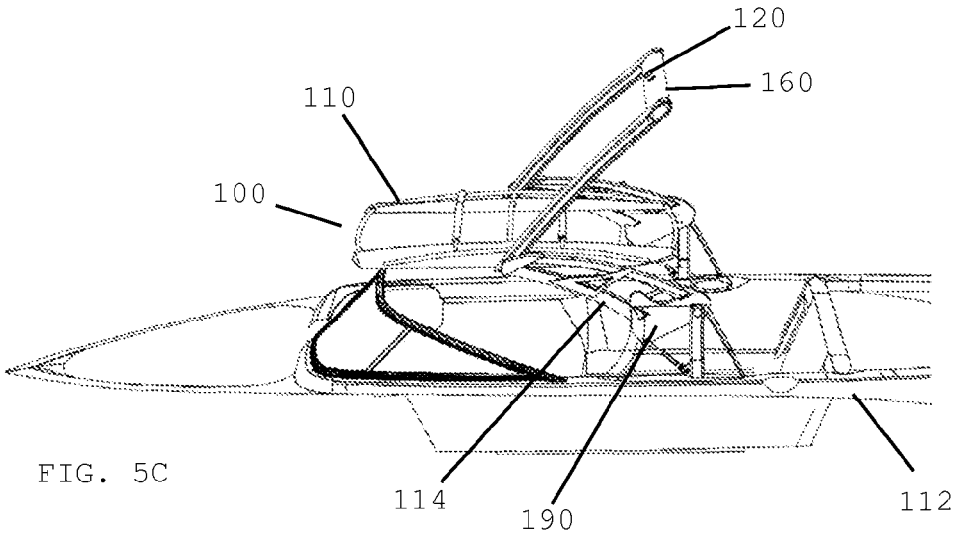
FIG. 5C shows the height adjustable tower and cargo rack apparatus partially extended.
Figure 5D:
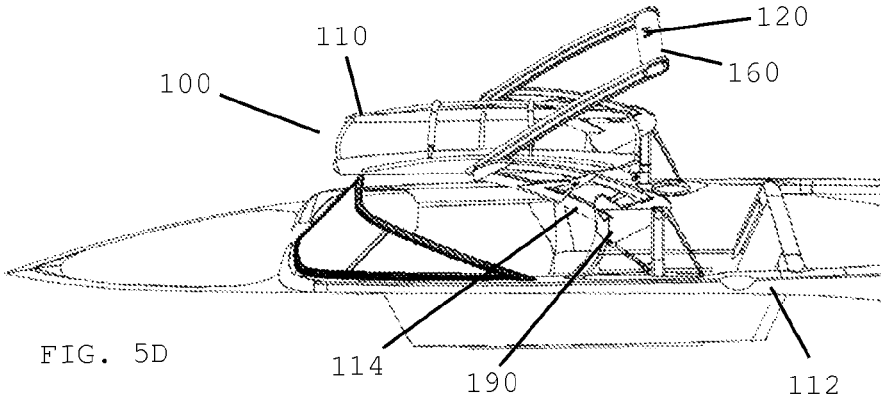
FIG. 5D shows the height adjustable tower and cargo rack apparatus partially extended.
Figure 5E:
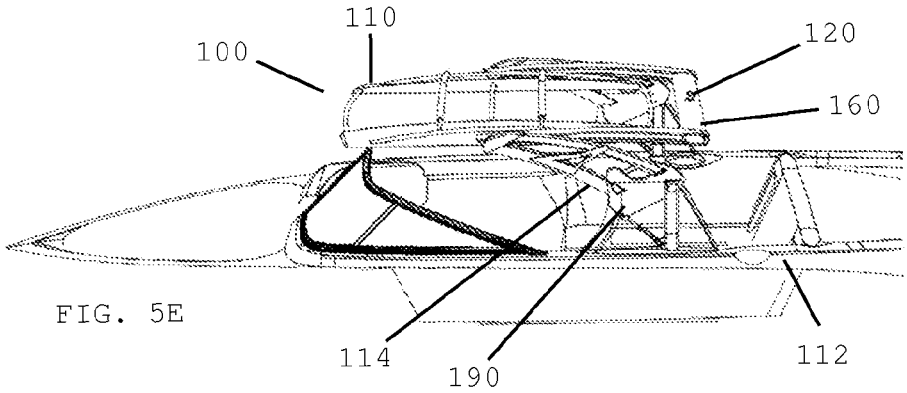
FIG. 5E shows the height adjustable tower and cargo rack apparatus partially extended.
Figure 5F:
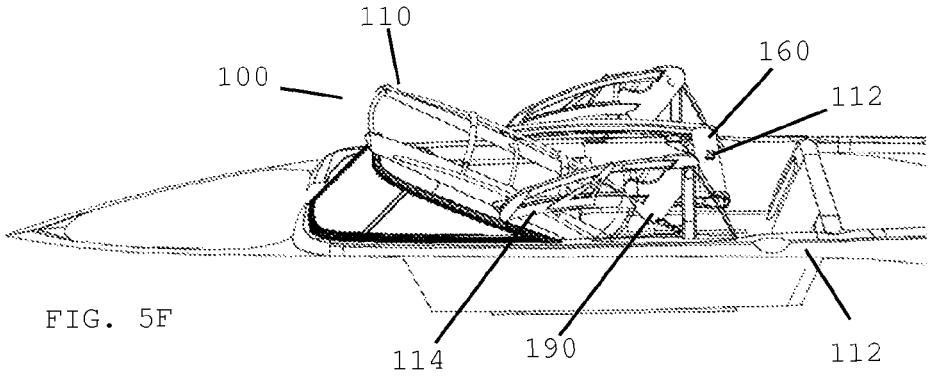
FIG. 5F shows the height adjustable tower and cargo rack apparatus fully retracted.

FIGS. 5A thru 5F presents the height adjustable tower and cargo rack apparatus 100 of the instant invention as it transitions from the fully extended position shown in FIG. 5A to the fully retracted position as shown in FIG. 5F. Of particular note is that the height of the upper section 160 varies independently of the change in height of the cargo rack apparatus 110 through at least a portion of the transition. Further, the height of the cargo rack apparatus 110 varies independently of the height of the upper section 160 through at least a portion of the transition. This allows users to independently vary the tower height (and thereby the cargo rack apparatus 110 height), vary the cargo rack apparatus 110 rake or pitch angle, and/or vary the rake or pitch angle of the upper tower section 160 (and thereby adjust the ski tow attachment point).

The foregoing disclosure is sufficient to enable one having skill in the art to practice the invention without undue experimentation, and provides the best mode of practicing the invention presently contemplated by the inventor. While there is provided herein a full and complete disclosure of the preferred embodiments of this invention, it is not intended to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Accordingly, the proper scope of the present invention should be determined only by the broadest interpretation of the appended claims so as to encompass all such modifications as well as all relationships equivalent to those illustrated in the drawings and described in the specification.

What is claims is:

1. A height adjustable tower and cargo rack apparatus for wakeboard boats, said apparatus comprising:

a first tower base attached at its lower portion to a port side gunwale of said boat, the first tower base having a first tower base powered actuator;

a second tower base attached at its lower portion to a starboard side gunwale of said boat, the second tower base having a second tower base powered actuator;

a first tower mount pivotally attached to an aft upper portion of the first tower base at a first tower first pivot point joint;

a second tower mount pivotally attached to an aft upper portion of the second tower base at a second tower first pivot point joint;

first and second vertical supports pivotally extending from each tower mount, wherein the vertical supports are pivotally operated by their respective tower base powered actuator;

a height adjustable upper tower section which is pivotally supported by the vertical supports at the upper ends of the vertical supports, and a pivotally adjustable cargo rack apparatus adjustably supported within the height adjustable upper tower section.

2. The apparatus of claim 1 wherein each powered actuator is respectively connected at its first end to a forward lower portion of the respective tower mount and at its second end to an aft lower portion of the respective tower base, and wherein the first tower mount and the second tower mount pivot about the respective first pivot point joint when the respective powered actuator is extended or retracted.

3. The apparatus of claim 2 wherein each first pivot point joint includes a base locking mechanism which is locked to prevent rotation of the respective tower mount about the respective first pivot point joint, or unlocked to allow rotation of the respective tower mount about the respective first pivot point joint.

4. The apparatus of claim 1 wherein the first and second vertical support upper ends of the first tower mount forms a first tower second pivot point joint, and the first and second vertical support upper ends of the second tower mount forms a second tower second pivot point joint.

5. The apparatus of claim 4 wherein each second pivot point joint includes a cam-lever locking mechanism, wherein a segment of the height adjustable upper tower section is connected to each second pivot point joint by the respective cam-lever locking mechanism, and wherein the cam-lever locking mechanisms are locked to prevent rotation of the height adjustable upper tower section about the second pivot point joints, and wherein the cam-lever locking mechanisms are unlocked to allow rotation of the height adjustable upper tower section about the second pivot point joints.

6. The apparatus of claim 1 wherein each powered actuator is respectively connected at its first end to a forward lower portion of the respective tower mount and at its second end to an aft lower portion of the respective tower base;

wherein the first tower mount and the second tower mount pivot about the respective first pivot point joint when the respective powered actuator is extended or retracted;

wherein each first pivot point joint includes a base locking mechanism which is locked to prevent rotation of the respective tower mount about the respective first pivot point joint, or unlocked to allow rotation of the respective tower mount about the respective first pivot point joint;

wherein the first and second vertical support upper ends of the first tower mount forms a first tower second pivot point joint;

the first and second vertical support upper ends of the second tower mount forms a second tower second pivot point joint;

wherein each second pivot point joint includes a cam-lever locking mechanism, wherein a segment of the height adjustable upper tower section is connected to each second pivot point joint by the respective cam-lever locking mechanism;

wherein the cam-lever locking mechanisms are locked to prevent rotation of the height adjustable upper tower section about the second pivot point joints, and wherein the cam-lever locking mechanisms are unlocked to allow rotation of the height adjustable upper tower section about the second pivot point joints.

* * * * *

UNITED STATES PATENT AND TRADEMARK OFFICE

CERTIFICATE OF CORRECTION

PATENT NO. : 8,297,484 B2
APPLICATION NO. : 13/180542
DATED : October 30, 2012
INVENTOR(S) : Raymond L. Jesewitz and Derek Drew Geary It is certified that error appears in the above-identified patent and that said Letters Patent is hereby corrected as shown below:

In the Specification

Please replace the entire paragraph col. 1 lines 8-19 with the below paragraph:

This application is a Continuation-In-Part of U.S. Patent Application No. 11/711,282, filed February 27, 2007, now U.S. Patent 8,025,194, issued September 27, 2011. Further U.S. Patent Application No. 11/711,282 is a Continuation-in-part of International Application No. PCT/US2005/047583, filed 28 December 2005 [now withdrawn], which claims the benefit of U.S. Provisional Patent Application No. 60/640,004, filed 28 December 2004 [now expired] and U.S. Patent Application No. 11/711,282 also claims the benefit of U.S. Provisional Patent Application No. 60/777,060, filed 27 February 2006 [now expired].
Further, this application claims the benefit of U.S. Provisional Patent Application No. 61/363,259 filed July 11, 2010, [expired] and is incorporated by reference in it's entirety as if fully set forth herein.

Signed and Sealed this
Fourth Day of August, 2015

Michelle K. Lee

Michelle K. Lee
*Director of the United States Patent and Trademark Office*